US011047593B2

(12) United States Patent
Latham

(10) Patent No.: US 11,047,593 B2
(45) Date of Patent: Jun. 29, 2021

(54) AIR CONDITIONING HOUSING SYSTEM

(71) Applicant: Johnson Controls Technology Company, Auburn Hills, MI (US)

(72) Inventor: Angus B. Latham, Seminole, FL (US)

(73) Assignee: Johnson Controls Technology Company, Auburn Hills, MI (US)

( * ) Notice: Subject to any disclaimer, the term of this patent is extended or adjusted under 35 U.S.C. 154(b) by 83 days.

(21) Appl. No.: 15/880,336

(22) Filed: Jan. 25, 2018

(65) Prior Publication Data

US 2018/0224153 A1 Aug. 9, 2018

Related U.S. Application Data

(60) Provisional application No. 62/454,519, filed on Feb. 3, 2017.

(51) Int. Cl.

| | |
|---|---|
| ***F24F 13/20*** | (2006.01) |
| ***F24F 3/044*** | (2006.01) |
| *F24F 7/00* | (2021.01) |
| *F24F 1/02* | (2019.01) |
| *F25D 19/02* | (2006.01) |

(52) U.S. Cl.

CPC ..... *F24F 13/20* (2013.01); *F24F 3/0442* (2013.01); *F24F 1/02* (2013.01); *F24F 2007/004* (2013.01); *F24F 2221/14* (2013.01); *F24F 2221/36* (2013.01); *F25D 19/02* (2013.01)

(58) Field of Classification Search

CPC .... F24F 13/20; F24F 2221/14; F24F 2221/36; F24F 1/02; F25D 19/02

See application file for complete search history.

(56) References Cited

U.S. PATENT DOCUMENTS

| | | | | | |
|---|---|---|---|---|---|
| 3,357,763 | A * | 12/1967 | Toper | F24F 1/0007 | 312/236 |
| 3,479,104 | A * | 11/1969 | Kobryner | H02B 1/38 | 312/229 |
| 5,829,617 | A * | 11/1998 | Umiker | B65D 1/225 | 220/6 |
| 6,688,712 | B2 | 2/2004 | Adams et al. | | |
| 6,820,952 | B2 * | 11/2004 | Austin | F24F 3/0442 | 312/265.1 |
| 7,252,696 | B2 | 8/2007 | Jenkins et al. | | |
| 7,757,510 | B2 * | 7/2010 | Rosete | F24F 3/0442 | 312/257.1 |

(Continued)

*Primary Examiner* — Frantz F Jules
*Assistant Examiner* — Lionel Nouketcha
(74) *Attorney, Agent, or Firm* — Fletcher Yoder, P.C.

(57) ABSTRACT

In one embodiment, a housing system for a heating, ventilating, and air conditioning (HVAC) unit includes a rigid shell. The rigid shell includes a top panel, a front panel, and a rear panel. The HVAC unit also includes a bottom panel configured to be disposed within a first portion of a bottom plane of the HVAC unit, a first side panel, and a second side panel. The first side panel and the second side panel are each configured to be disposed within respective side planes of the HVAC unit and are each configured to be disposed within respective second portions of the bottom plane. The housing system is configured to be internally accessed through the respective side planes. Internal access of the housing system through either of the respective side planes is provided at least partially by rotation of the first side panel and/or the second side panel.

24 Claims, 8 Drawing Sheets

(56) References Cited

U.S. PATENT DOCUMENTS

| | | | | |
|---|---|---|---|---|
| 9,518,747 | B2 * | 12/2016 | Lee | F24F 1/56 |
| 2005/0055919 | A1 * | 3/2005 | Dubensky | E04B 1/80 52/302.1 |
| 2005/0170772 | A1 * | 8/2005 | De Domenico | F24F 13/085 454/254 |
| 2008/0035635 | A1 * | 2/2008 | Moffett | F24F 3/1603 220/4.28 |
| 2012/0199312 | A1 | 8/2012 | Zeng et al. | |
| 2015/0013251 | A1 | 1/2015 | Waelde et al. | |

* cited by examiner

AIR CONDITIONING HOUSING SYSTEM

CROSS-REFERENCE TO RELATED APPLICATION

This application claims priority to and the benefit of U.S. Provisional Application No. 62/454,519 entitled "HORIZONTAL FAN COIL UNIT REMOVEABLE SIDE ACCESS PANEL," filed Feb. 3, 2017, which is hereby incorporated by reference in its entirety for all purposes.

BACKGROUND

The present disclosure relates generally air conditioning units. Specifically, the present disclosure relates to air conditioning units with accessible internal components.

Air conditioning units may be mounted on ceilings of rooms within a building. For example, an air conditioning unit may be included in an office, a hotel room, a hospital room, etc. The air conditioning unit may recycle air from the room by conditioning the air through one or more heat exchange processes. That is, the air conditioning unit may draw in air from the room, remove heat or add heat to the air, depending on one more preferences or settings, and may also remove moisture from the air. The air conditioning unit may then supply the conditioned air to the room via one or more blowers or fans. The air conditioning unit may also be aesthetically acceptable in its exposed location within a frequented room. Indeed, interior components of the air conditioning unit may be covered by one or more panels to present the air conditioning unit in an aesthetic manner. To be properly installed and maintained, service personal may access the interior components of the unit through the one or more panels. However, due at least to the mounting location of the air conditioning unit, the panels may be difficult to access and/or provide limited access, such as for tools usage, to the internal components, thereby increasing time and difficulty of installation and maintenance operations and also increasing costs associated with such operations.

DRAWINGS

BRIEF SUMMARY

Figure 1:
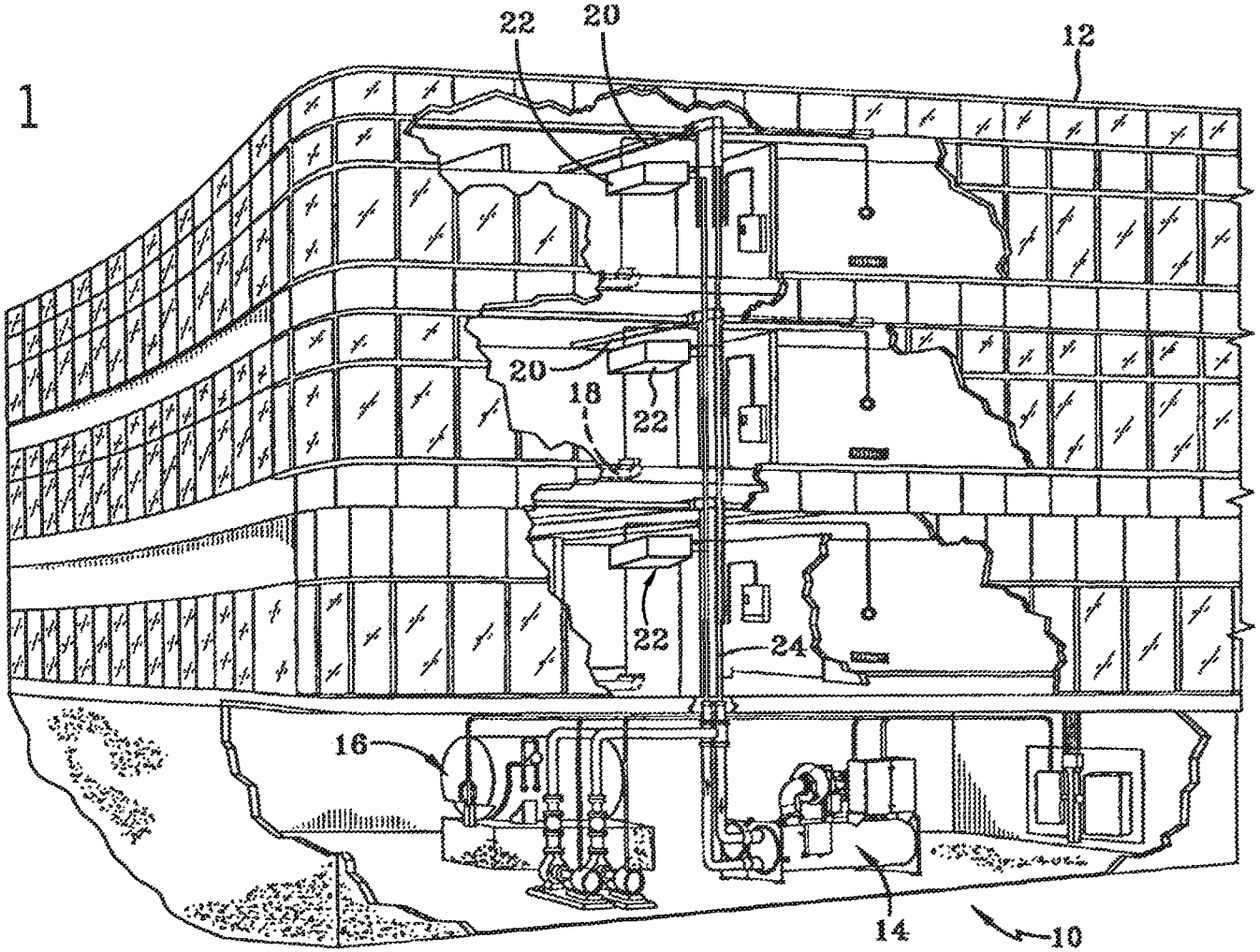
FIG. 1 is a perspective view of an embodiment of a building that may utilize a heating, ventilation, air conditioning, and refrigeration (HVAC&R) system in a commercial setting, in accordance with an aspect of the present disclosure.

In one embodiment, a housing system for a heating, ventilating, and air conditioning (HVAC) unit includes a rigid shell. The rigid shell includes a top panel configured to be disposed within a top plane of the HVAC unit, a front panel configured to be disposed within a front plane of the HVAC unit, and a rear panel configured to be disposed within a rear plane of the HVAC unit. The HVAC unit also includes a bottom panel configured to be disposed within a first portion of a bottom plane of the HVAC unit, a first side panel, and a second side panel. The first side panel and the second side panel are each configured to be disposed within respective side planes of the HVAC unit and are each configured to be disposed within respective second portions of the bottom plane of the HVAC unit. The housing system is configured to be internally accessed through the respective side planes. Internal access of the housing system through either of the respective side planes is provided at least partially by rotation of the first side panel and/or the second side panel.

In another embodiment, a housing system for a heating, ventilating, and air conditioning (HVAC) unit includes a shell. The shell includes a rear panel disposed within a rear plane of the HVAC unit, a top panel disposed within a top plane of the HVAC unit, and a front panel disposed within a front plane of the HVAC unit. The housing system also includes two corner panels configured to be coupled to the shell. Each of the two corner panels is configured to be disposed within a respective side plane of the HVAC unit and within the bottom plane. The housing system further includes a bottom panel configured to be coupled to the shell. The bottom panel is configured to be disposed within a bottom plane of the HVAC unit, and is configured to be removed from the shell. Removal of the bottom panel enables removal of the two corner panels. The housing system is configured to be mounted to a ceiling of a room in a building, and the shell is configured to enclose an air conditioning unit.

In a further embodiment, a heating, ventilating, and air conditioning (HVAC) system includes an air conditioning unit configured to be mounted to a ceiling of a room in a building. The air conditioning unit is configured to supply conditioned air to the room. The air conditioning unit includes a heat exchanger configured to receive chilled fluid from a vapor compression system and/or receive warm fluid from a boiler. The HVAC system also includes a housing configured to surround internal components of the air conditioning unit. The housing includes a top panel, a bottom panel, a front panel, a rear panel, and two side panels. The bottom panel is configured to be disposed within a bottom plane of housing, and the two side panels are configured to be disposed within respective side planes of the housing and within the bottom plane of the housing. The internal components of the air conditioning unit are configured to be accessed through the respective side planes and the bottom plane.

DETAILED DESCRIPTION

An area of a building, such as a room, may include an air conditioning unit mounted to a ceiling. The air conditioning unit may utilize one or more heat exchange processes to supply conditioned air to the room. In some instances, the air conditioning unit may be mounted such that one or more components within the air conditioning unit may be difficult to access by installation personnel and other operators. Indeed, in some instances, internal components of the air conditioning unit may only be accessed from a bottom of the air conditioning unit. Further, due at least to its exposed location within the room, a chassis or housing of the air conditioning unit may ideally be aesthetically pleasing. For example, the housing may include a limited amount of exposed hardware, such as screws, bolts, hinges, weld joints, and so forth.

Embodiments of the present disclosure include an air conditioning unit of a heating, ventilating, air conditioning, and refrigeration (HVAC&R) system that may provide accessible internal components via a housing utilizing a minimal amount of exposed hardware. For example, in some embodiments, a housing of the air conditioning unit may include a front panel, a rear panel, a top panel, a bottom panel, and two side panels. The side panels may cover a bottom portion of the air conditioning unit in addition to side portions of the air conditioning unit. That is, each side panel may include a vertical plane portion to cover the side portions and a horizontal plane portion to partially cover the bottom portion. The bottom panel may cover a remainder of the bottom portion that is not covered by the side panels.

In some embodiments, to access the internal components of the air conditioning unit, two exposed fasteners within the bottom panel may first be uncoupled, thereby permitting the bottom panel to swing about one or more hinges. In some embodiments, the bottom panel may hang from the one or more hinges or be decoupled from the chassis entirely. Once the bottom panel is opened, two or more additional fasteners coupling the side panels to the rest of the chassis may be decoupled. Once the two or more additional fasteners have been decoupled, the side panels may be permitted to swing open about shafts upon which the side panels may sit. Particularly, the side panels may include a hook that is configured to fit about the shafts. The side panels may swing outwardly from the shafts and/or may be lifted off of the shafts. In this manner, service personnel may easily access internal components of the air conditioning unit through the vertical planes covered by the side panels, thereby increasing an ease of installation and maintenance of the air conditioning unit over traditional ceiling-mounted air conditioning units that may only be accessible through a horizontal plane in the bottom of the air conditioning unit.

Turning now to the drawings, FIG. 1 is a perspective view of an embodiment of an environment for a heating, ventilation, and air conditioning (HVAC) system 10 in a building 12 for a typical commercial setting. The HVAC system 10 may include a vapor compression system 14, such as a chiller, that supplies a chilled liquid, which may be used to cool the building 12. The HVAC system 10 may also include a boiler 16 to supply warm liquid to heat the building 12 and an air distribution system which circulates air through the building 12. The air distribution system can also include an air return duct 18, an air supply duct 20, and/or an air conditioning unit 22, or air handler. In some embodiments, the air conditioning unit 22 may include a heat exchanger that is connected to the boiler 16 and the vapor compression system 14 by conduits 24. The heat exchanger within the air conditioning unit 22 may receive warm liquid from the boiler 16 and/or chilled liquid from the vapor compression system 14, depending on the mode of operation of the HVAC system 10. The HVAC system 10 is shown with a separate air conditioning unit 22 on each floor of building 12, but in other embodiments, the HVAC system 10 may include air conditioning units 22 and/or other components that may be shared between or among floors. Additionally, individual rooms of the building 12 may be associated with a respective air conditioning unit 22. Further, in some embodiments, the air conditioning units 22 may be mounted to ceilings within the building 12.

Figure 2:
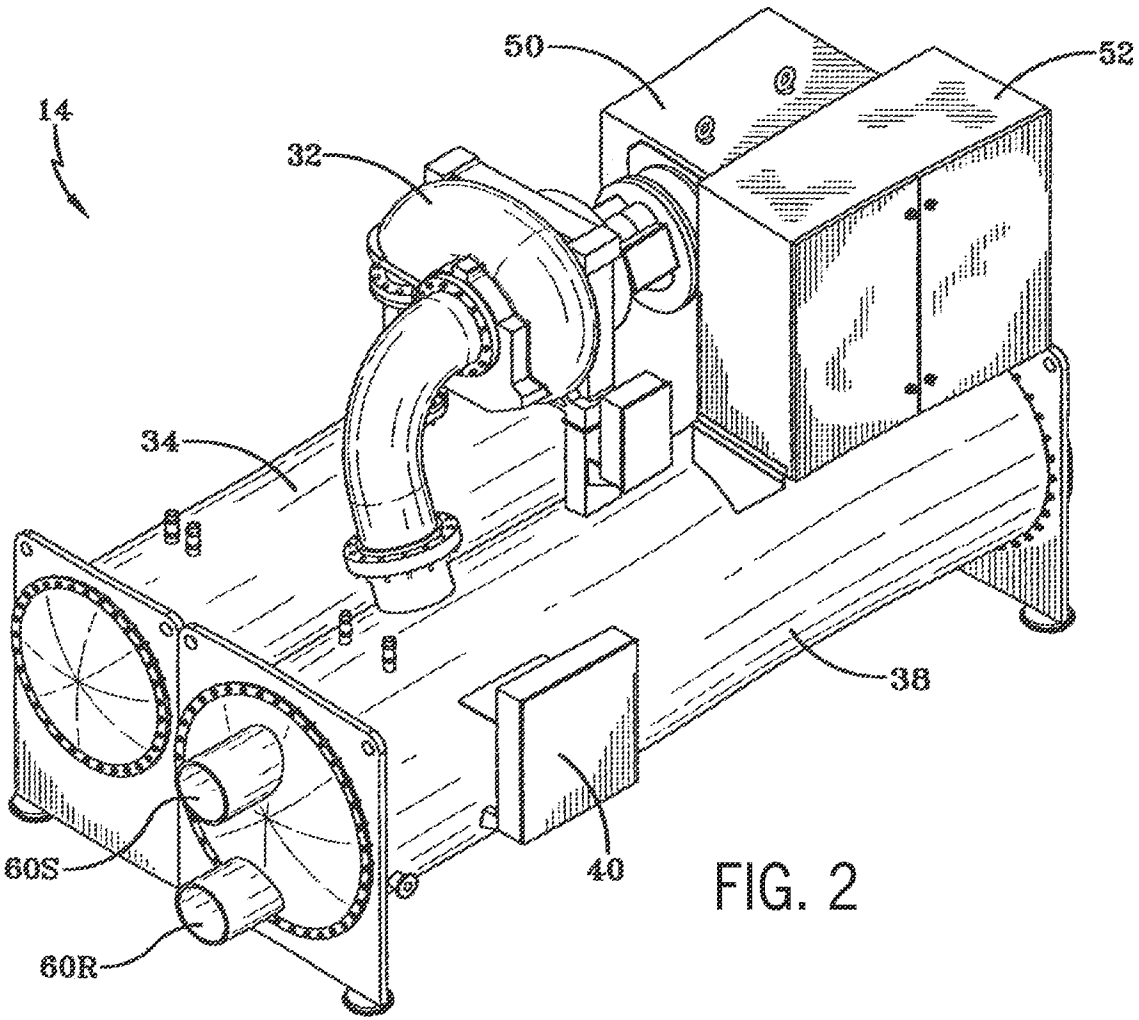
FIG. 2 is a perspective view of an embodiment of an HVAC&R system, in accordance with an aspect of the present disclosure.
Figure 3:
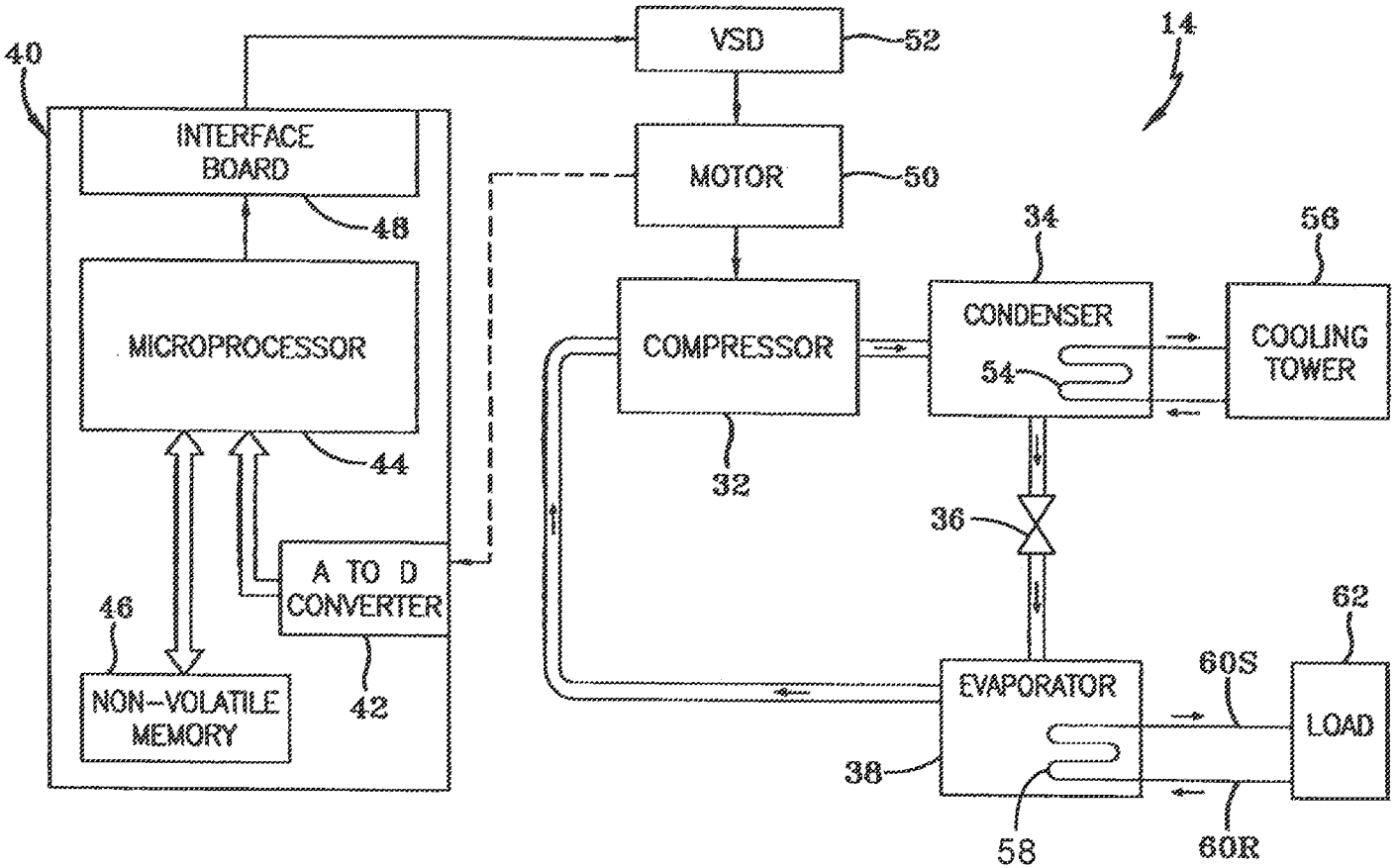
FIG. 3 is a schematic of an embodiment of the HVAC&R system of FIG. 2, in accordance with an aspect of the present disclosure.

FIGS. 2 and 3 are embodiments of the vapor compression system 14 that can be used in the HVAC system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia ($NH_3$), R-717, carbon dioxide ($CO_2$), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
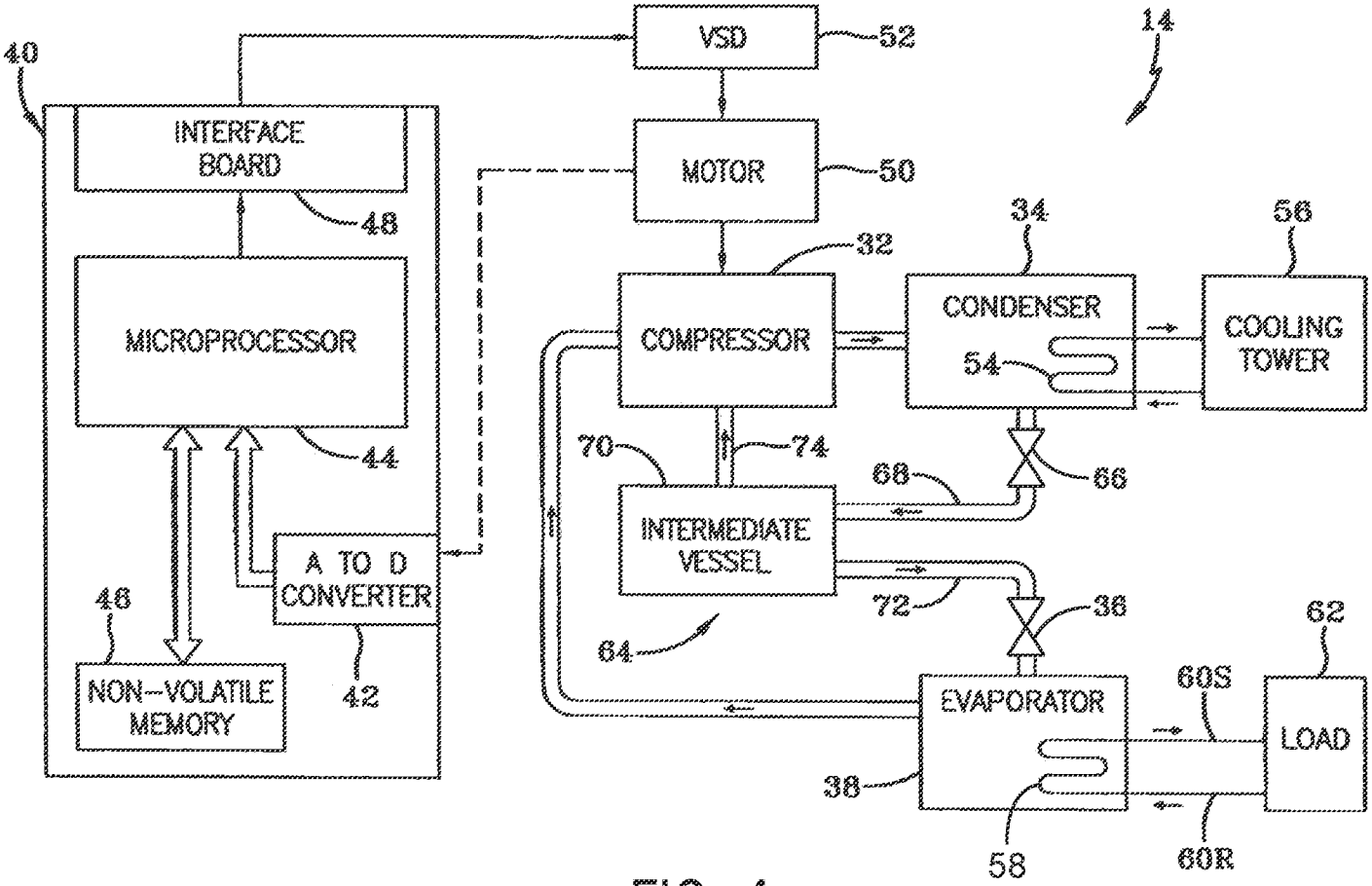
FIG. 4 is a schematic of an embodiment of the HVAC&R system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

As mentioned above, in some embodiments, the air conditioning unit 22 may be mounted to a ceiling within a building (e.g., the building 12). While mounted to the ceiling, the air conditioning unit 22 may be serviced. For example, in some embodiments, once the air conditioning unit 22 has been mounted to the ceiling, one or more service personnel may access the air conditioning unit 22 to install and/or maintain valve packages, electrical systems, pumps, coils, control systems, motors, or any combination thereof. Accordingly, the air conditioning unit 22 may include panels that allow easy access to the components located within the air conditioning unit 22. Particularly, the panels may expose the internal components of the air conditioning unit 22 while utilizing a minimal amount of clearance vertically and laterally of the air conditioning unit 22 relative to the walls and ceiling of the room in which the air conditioning unit 22 is mounted. As discussed herein, the term "horizontal" may refer to a direction, or plane, substantially parallel with a level ground, and the term "vertical" may refer to a direction, or plane, that is substantially perpendicular with a level ground.

Figure 5:
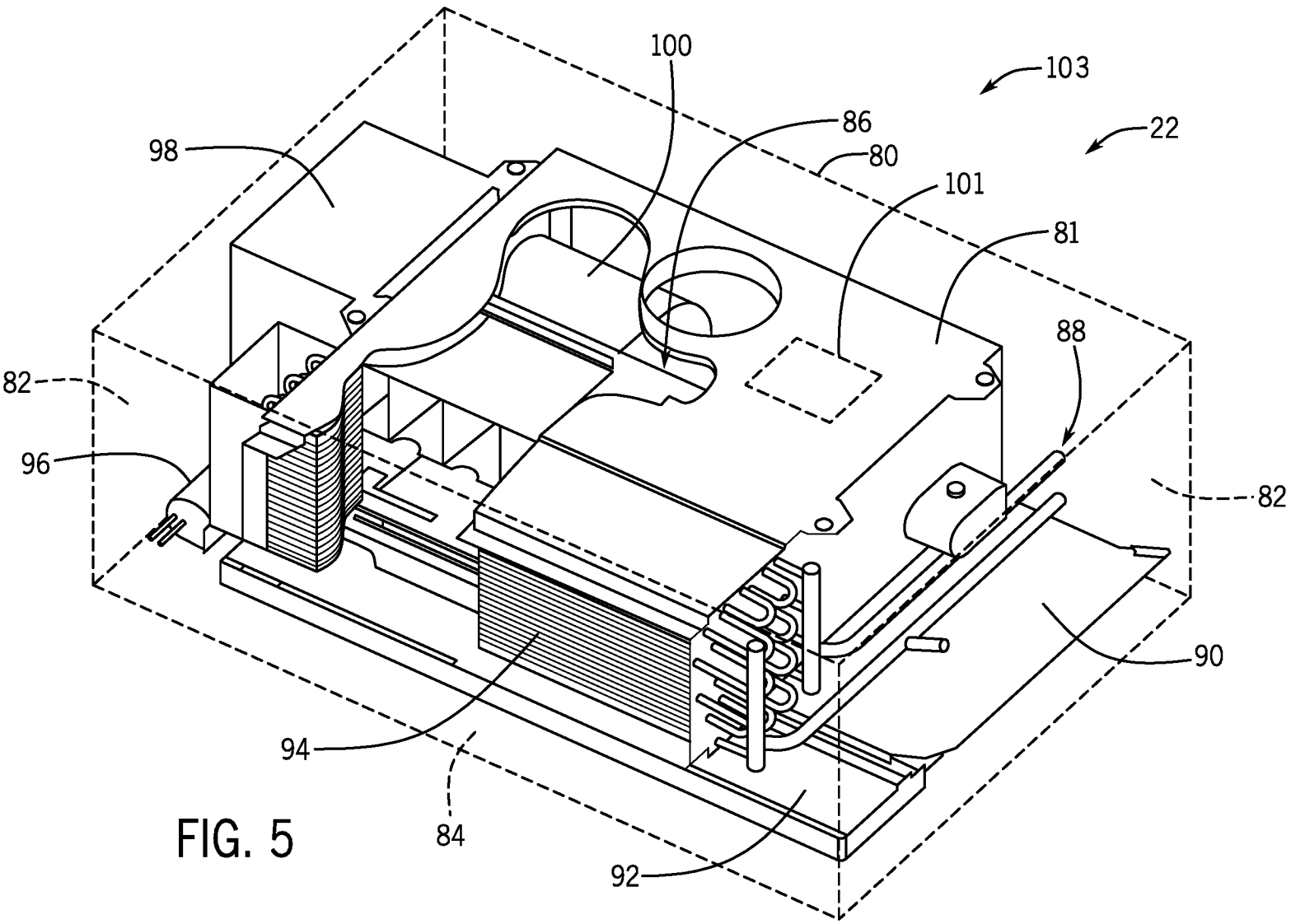
FIG. 5 is a perspective view of interior components of an air conditioning unit of the HVAC&R system of FIG. 2, in accordance with an aspect of the present disclosure.

FIG. 5 is an embodiment of the air conditioning unit 22 which may receive chilled liquid from the vapor compression system 14 and/or warm liquid from the boiler 16. The air conditioning unit 22 may include a variety of components that may be covered by a housing 80, which may include multiple panels as discussed in further detail below. As mentioned above, the air conditioning unit 22 may be mounted to a ceiling of a room in a building. Particularly, the air conditioning unit 22 may be mounted to the ceiling via the housing 80, a frame 81 of the air conditioning unit 22, or both. Components within the air conditioning unit 22 may be accessed through one or more vertical planes 82, or side planes, and a horizontal plane 84, or bottom plane, covered by the housing 80. For example, in some embodiments, a motor 86, a valve package 88, an auxiliary drain pan 90, a removable drain pan 92, coils 94, a condensate pump 96, an electrical enclosure 98, an air supply device 100, a chilled beam 101, or any combination thereof may be accessible through the horizontal plane 84 and/or the vertical planes 82.

The motor 86 may drive the air supply device 100, such as a fan or blower, to provide conditioned air to a room. For example, in some embodiments, the air supply device 100 may draw in air from the room, push or pull the air across the coils 94 to condition the air, and then supply the conditioned air to the room. Indeed, the motor 86 may drive the air supply device 100 to place the air drawn from the room in a heat exchange relationship with liquid flowing through the coils 94, thereby removing moisture from the air and either heating or cooling the air, depending on one or more settings/preferences.

The electrical enclosure 98 may include one or more control devices, such as a microprocessor, memory, power source, or any combination thereof, to control one or more operations of the air conditioning unit 22. For example, elements of the electrical enclosure 98 may be communicatively coupled to one or more input devices, such as a thermostat, in which a user may input a set temperature. Based on the set temperature relative to an actual room temperature, elements of the electrical enclosure 98 may then send one or more signals to one or more components of the air conditioning unit 22 to supply an adequate amount of air with a suitable temperature to maintain the room at the set point temperature. Further, while the air is in a heat exchange relationship with liquid flowing through the coils 94, portions of the air may condense into a liquid and collect in the removable drain pan 92 and/or the auxiliary drain pan 90. Indeed, the condensate pump 96 may remove the condensate that collects in the removable drain pan 92 and/or the auxiliary drain pan 90. The valve package 88 may supply and control the flow of chilled liquid and/or warm liquid to the coils 94 from the vapor compression system 14 and/or the boiler 16. Further still, the chilled beam 101 of the air conditioning unit 22 may include pipes configured to flow chilled fluid, such as water, to cool surrounding air, thereby providing cooled air to the room. In certain embodiments, the air conditioning unit 22 may be a variable air volume (VAV) system 103. That is, the air conditioning unit 22 supply a varied amount of airflow at a constant temperature to condition the room.

Figure 6:
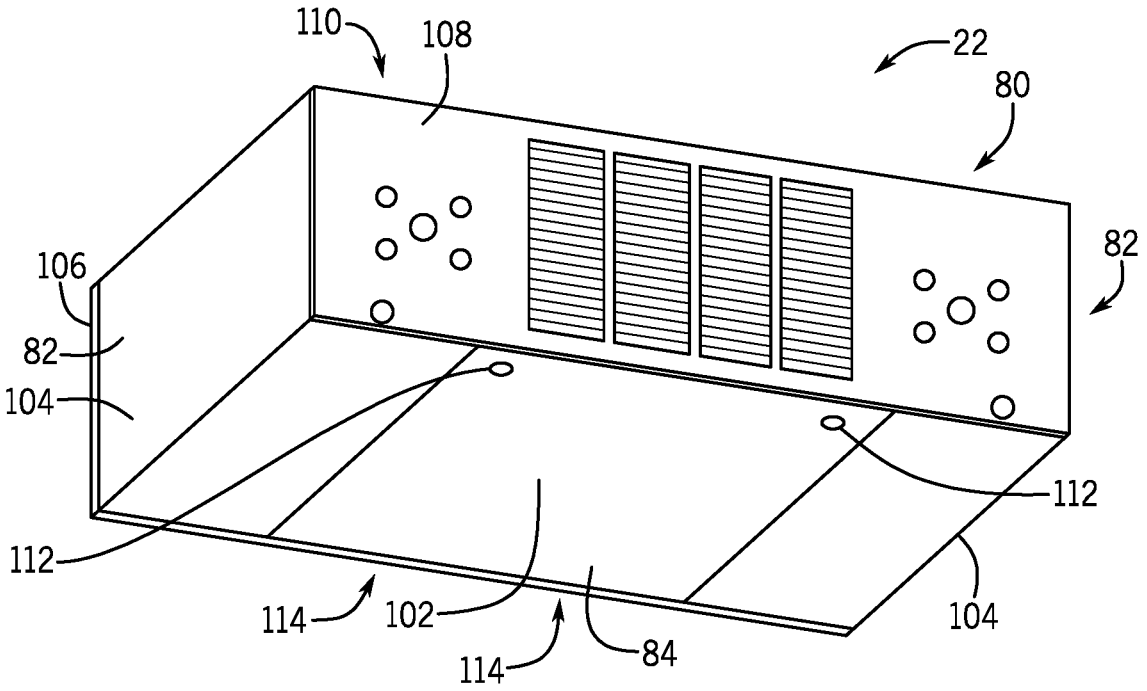
FIG. 6 is a perspective view of a housing of the air conditioning unit of FIG. 5, in accordance with an aspect of the present disclosure.

FIG. 6 is a perspective view of the air conditioning unit 22 with the housing 80 covering the internal components. As mentioned above, the housing 80 may include a bottom panel 102, which may be disposed within the horizontal plane 84 (e.g., a bottom plane), two side panels 104, or corner panels, which may be disposed within the vertical planes 82 (e.g., side planes) and one or more portions of the horizontal plane 84, a front panel 106, which may be disposed within a front plane, a rear panel 108, which may be disposed within a rear plane, and a top panel 110, which may be disposed within a top plane. Particularly, the planes of the housing 80 may form a box about the air conditioning unit 22. In some embodiments, portions of the housing 80 may be integrally formed. For example, in some embodiments, two or more of the panels 102, 104, 106, 108, 110 may be formed together from bending and stamping sheet metal. In specific embodiments, the front panel 106, the rear panel 108, the top panel 110 may be integrally formed together through welding, bolting, bending from one or more pieces of sheet metal, or any combination thereof to form a shell.

The internal components of the air conditioning unit 22 may be accessed by opening the bottom panel 102. Particularly, the bottom panel 102 may include one or more fasteners 112 coupling the bottom panel 102 to a base of the air conditioning unit 22 and/or to the rear panel 108. In specific embodiments, the bottom panel 102 may include two fasteners 112 coupling the bottom panel 102 to the base of the air conditioning unit 22 and/or to the rear panel 108. In some embodiments, the fasteners 112 of the bottom panel 102 may be the only exposed hardware of the housing 80. Further, the fasteners 112 may be quarter-turn hardware that is configured to be decoupled with approximately ninety degrees of rotation, or between approximately eighty-five to ninety-five degrees of rotation. In some embodiments, the fasteners 112 may be latches. Further still, in some embodiments, the fasteners 112 may be inset of the bottom panel 102 such that the fasteners 112 are flush with the bottom panel 102 and do not extend beyond an outer surface of the bottom panel 102. In some embodiments, once the fasteners 112 have been rotated to decouple the bottom panel 102 from the air conditioning unit 22, the fasteners 112 may remain contained within the bottom panel 102 such that the fasteners 112 do not drop to the ground once decoupled, or unscrewed. In some embodiments, there may not be any exposed bolt heads, screw heads, or other fasteners, other than the fasteners 112 disposed within the bottom panel 102, when the panels 102, 104, 106, 108, 110 of the chassis 80 are all coupled together, as shown in the current embodiment.

Once the fasteners 112 have been rotated to decouple the bottom panel 102 from the air conditioning unit 22, the bottom panel 102 may be permitted to swing open about one or more hinges 114. In some embodiments, the hinges 114 may not be visible from a point of view that is external to the air conditioning unit 22. For example, in some embodiments, the hinges 114 may include one or more extensions of the bottom panel 102 that may fit into slots disposed within an internal portion of the front panel 106. Once the fasteners 112 have been decoupled, the bottom panel 102 and the one or more extensions may rotate within the slots (e.g., the hinge 114) of the front panel 106. In some embodiments, the bottom panel 102 may be removable from the hinge 114, and more specifically from the front panel 106, once the fasteners 112 have been decoupled. In some embodiments, the bottom panel 102 may be rotated sufficiently to allow for insertion/withdrawal of a standard sized air filter to/from the air conditioning unit 22.

In some embodiments, the bottom panel 102 may account for a portion of an underside of the housing 80. Particularly, the bottom panel 102 may be disposed within a center portion of the horizontal plane 84 of the housing 80 with the side panels 104 covering remaining portions of the horizontal plane 84. For example, the side panels 104 (e.g., corner panels) may include a vertical portion 116 to cover the vertical plane 82, or lateral sides, of the housing 80 and a horizontal portion 118 to cover the remaining portions of horizontal plane 84 not covered by the bottom panel 102, as illustrated in the current embodiment. In some embodiments, the vertical portion 116 and the horizontal portion 118 of the side panel 104 may have been integrally formed through bending of a single piece of sheet metal. Further, it should be noted that while the side panel 104 may be referred to as having the vertical portion 116 and the horizontal portion 118, the vertical portion 116 may not always be disposed vertically and the horizontal portion 118 may not always be disposed horizontally at least due to the rotation of the side panel 104 and/or the housing 80. Further, considering that the side panel 104 may be rigid, the vertical portion 116 may remain substantially perpendicular relative to the horizontal portion 118.

Figure 7:
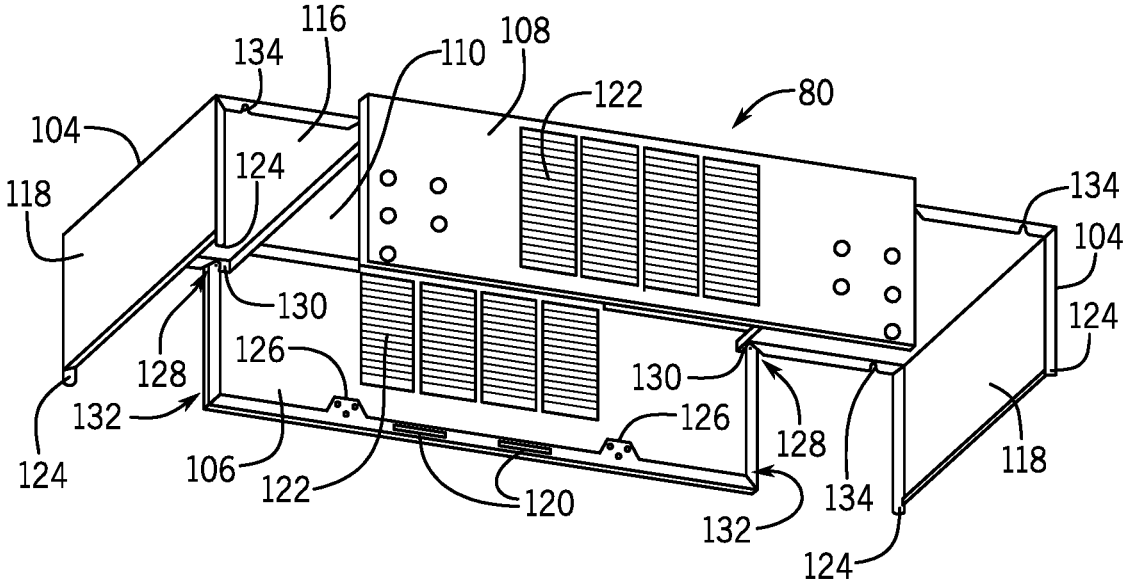
FIG. 7 is a perspective view of a housing of the air conditioning unit of FIG. 5, in accordance with an aspect of the present disclosure.

FIG. 7 is a perspective view of the housing 80 with the bottom panel 102 removed and the side panels 104 rotated outward to expose an internal volume of the housing 80 in which internal components of the air conditioning unit 22 may be disposed. As mentioned above, the bottom panel 102 may have been removed from one or more slots 120 disposed within the front panel 106. In some embodiments, the front panel 106 and/or the rear panel 108 may include vents 122 through which air may travel as supply air, such as conditioned air, or return air, such as air being drawn in from the room to be conditioned. In some embodiments, the bottom panel 102 (FIG. 6) may also include a vent 122 that, in some embodiments, may be used for supply air or return air.

In some embodiments, the horizontal portions 118 of the side panels 104 may be coupled to the front panel 106 and/or the rear panel 108 via one or more fasteners. Particularly, one or more protrusions 124 of the side panels 104 may be coupled to tabs 126. Indeed, in some embodiments, the front panel 106, the rear panel 108, or both may include the tabs 126 that may couple to the protrusions 124 of the side panels 104. In some embodiments, the protrusions 124 of the side panels 104 and the tabs 126 may each include corresponding holes that allow for the protrusions 124 and the tabs 126 to be coupled together via any suitable fasteners such as screws, bolts, thumb screws, quarter-turn hardware, etc.

Once the protrusions 124 of the side panels 104 have been decoupled from the tabs 126, the side panels 104 may be permitted to swing outward, as shown in the illustrated embodiment. Particularly, the side panels 104 may rotate about shafts or pegs 128 extending from the front panel 106 and the rear panel 108. In some embodiments, the shafts 128 may extend approximately 0.5 inches from the front panel 106 and/or the rear panel 108, or any other suitable distance. In certain embodiments, the shafts 128 may extend an entire length between the front panel 106 and the rear panel 108. As discussed below, the shafts 128 may be tapered and include a lip to provide a simplified coupling with the side panels 104. As also discussed in further detail below, the side panels 104 may include hooks 130 to couple to the shafts 128. Indeed, the hooks 130 may rest upon the shafts 128 and are configured to slide along an outer surface of the shafts 128 when the side panels 104 are rotated (e.g., inward or outward).

Further, the front panel 106 and/or the rear panel 108 may include pins 132 that may be received by pin receptacles 134 disposed within the side panels 104. Indeed, in some embodiments, the pins 132 may extend approximately 0.5 inches from the front panel 106 and/or the rear panel 108, or any other suitable distance. In some embodiment, the pin receptacles 134 may be a recession disposed within a flange of the side panels 104. As used herein, "rotated inward" may refer to a position of the side panels 104 as shown in FIG. 6, and "rotated outward" may refer to a position of the side panels 104 as shown in FIG. 7. Particularly, when the side panels 104 are rotated inward, the pin receptacles 134 may be disposed about the pins 132. In this manner, when the side panels 104 are rotated outward, the side panels 104 may easily be rotated inward again to the same position. Indeed, in some embodiments, the pins 132 may function as stops that may stop the inward rotation of the side panels 104. That is, when the side panels 104 are rotated inward and the pins 132 are disposed within the pin receptacles 134, the holes within the protrusions 124 may become aligned with the holes within the tabs 126.

Figure 8:
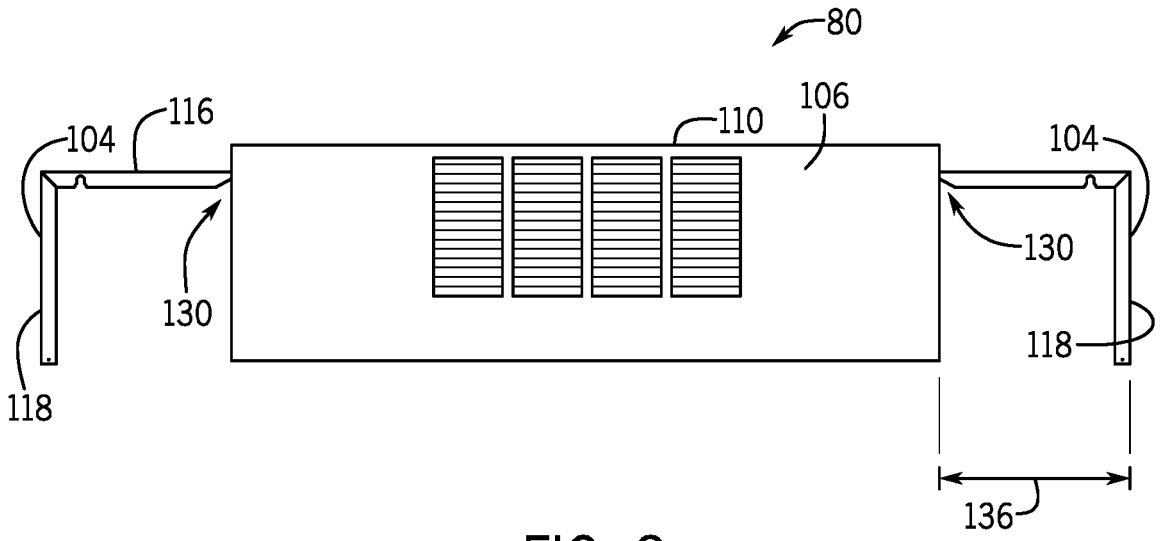
FIG. 8 is a front view of a housing of the air conditioning unit of FIG. 5, in accordance with an aspect of the present disclosure.

In some embodiments, the air conditioning unit 22 may be mounted with limited clearance between the housing 80 and elements of a room, such as walls and ceilings. FIG. 8 illustrates an embodiment of the housing 80 with the side panels 104 rotated outward. As shown in the illustrated embodiment, the side panels 104 are rotated outward such that the vertical portion 116 of each side panel 104 is substantially parallel with the top panel 110. While rotated outward, the side panels 104 may extend beyond the rest of the housing 80 a distance 136 that is approximately the length of the vertical portion 116. Particularly, the distance 136 that the side panels 104 extend beyond the housing 80 may be approximately equal to a distance between the hooks 130 and the horizontal portion 118. In some embodiments, the distance between the hooks 130 and the horizontal portion 118 may be approximately 11 inches. In this manner, side panels 104 may be rotated outward while the air conditioning unit 22 is mounted to in the room with minimal lateral clearances. That is, the internal components of the housing 80 may be accessed through the vertical planes 82 (FIG. 5) without any clearance above the housing 80 through rotation of the side panels 104. Indeed, in some embodiments, the side panels 104 may be removed from the housing 80 while rotated outward without being moved above the top panel 110. Therefore, in some embodiments, the top panel 110 may be disposed against a surface, such as a ceiling, and internal components of the air conditioning unit 22 may still be accessed.

Figure 9:
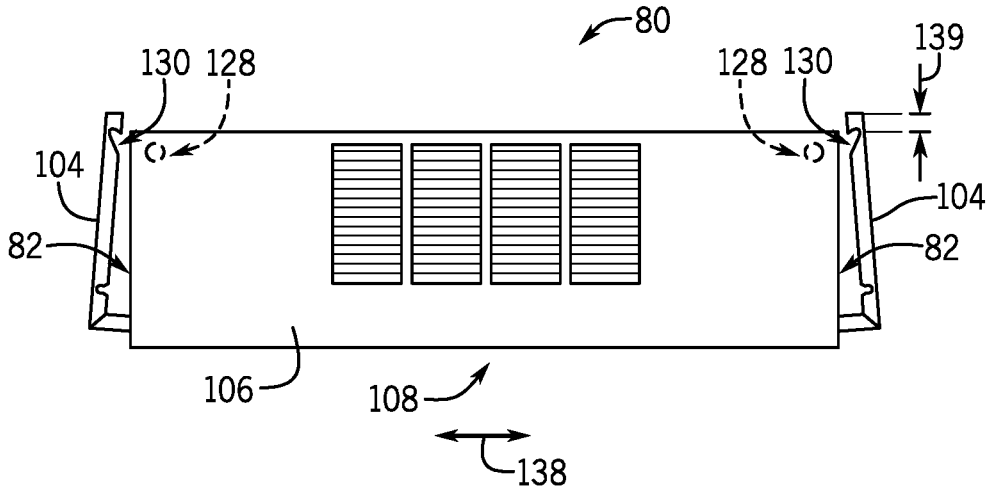
FIG. 9 is a front view of a housing of the air conditioning unit of FIG. 5, in accordance with an aspect of the present disclosure.

In some embodiments, the hooks 130 of the side panels 104 may be lifted off of the shafts 128, thereby decoupling the side panels 104 from the rest of the housing 80, and more particularly, decoupling from the shafts 128. For example, as shown in FIG. 9, the side panels 104 of the housing 80 may be decoupled from the front panel 106 and the rear panel 108 of the housing 80. In some embodiments, to decouple the side panels 104 from the rest of the housing 80, the side panels 104 may first be rotated some degree. For example, in some embodiments, once the side panels 104 have been rotated outwardly approximately five degrees, the side panels 104 may be lifted off of the shafts 128. Particularly, rotating the side panels 104 such that they may be lifted of the shafts 128 may extend the side panels approximately three inches in a lateral direction 138 beyond the housing 80. Therefore, the side panels may be removed from the housing 80 of the air conditioning unit 22 while the air conditioning unit 22 is mounted in a room with approximately three inches of clearance in the lateral direction 138. In this manner, the internal components of the air conditioning unit 22 may be accessible through the vertical plane 82 despite minimal clearances. Further, for the side panels 104 to be removed from the shafts 128, the side panels 104 may be lifted above the housing 80 a distance 139 that is approximately equal to a distance from the hook 130 to the end of the side panel 104.

Figure 10:
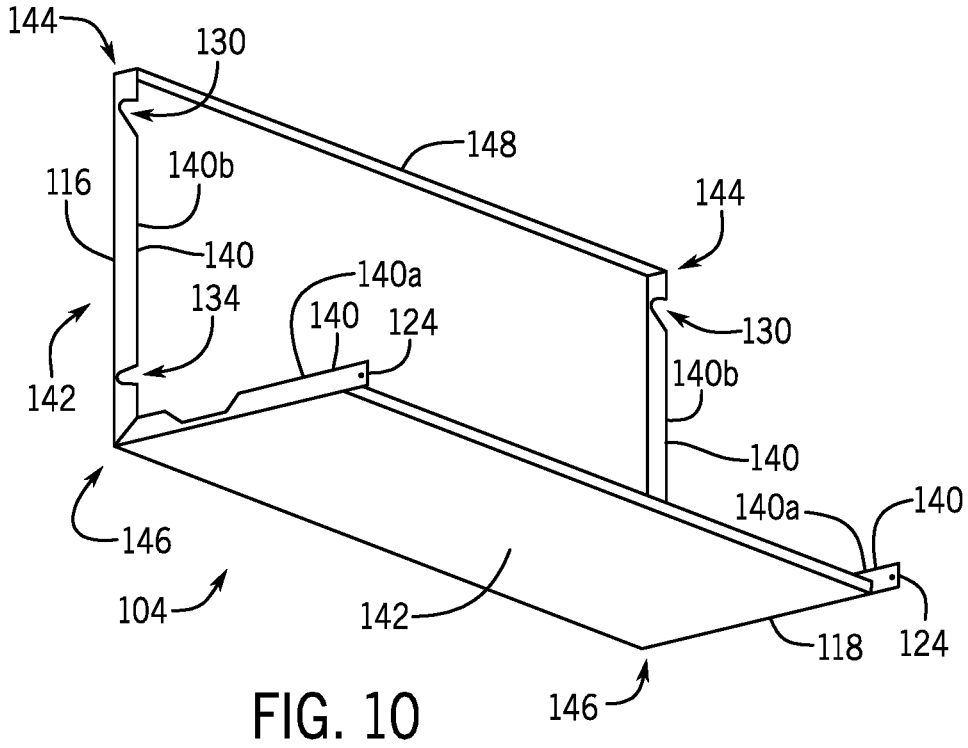
FIG. 10 is a perspective view of a panel of the air conditioning unit of FIG. 5, in accordance with an aspect of the present disclosure.

FIG. 10 is a perspective view of one of the side panels 104 of the housing 80. As mentioned above, the side panel 104 may include the vertical portion 116 and the horizontal portion 118. The side panel 104 may further include one or more flanges 140 extending from both of the vertical portion 116 and the horizontal portion 118 of the side panel 104. In some embodiments, the flanges 140 may extend a width of approximately 0.75 inches, or may extend any other suitable width. Particularly, the flanges 140 may extend away from outer surfaces 142 of the side panel 104.

The one or more flanges 140 may include the protrusions 124, the hooks 130, and the pin receptacles 134. Specifically, a flange 140*a* may extend substantially perpendicularly from the horizontal portion 118 and may include the protrusion 124. As mentioned above, in some embodiments, the protrusion 124 may include one or more holes configured to receive a fastener to couple the side panel 104 to the front panel 106 and/or the rear panel 108 (FIG. 7). In some embodiments, the protrusion 124 may extend approximately 0.674 inches beyond the horizontal portion 118 in a direction away from the vertical portion 116, or may extend any other suitable distance beyond the horizontal portion 118. In some embodiments, the protrusion 124 may include one or more rounded edges, as shown in the current embodiment. Further, a flange 140*b* may extend substantially perpendicularly from the vertical portion 116 and may include the hook 130 and the pin receptacle 134. As mentioned above, the hook 130 may be configured to engage with and/or rest upon the one or more shafts 128 of the front panel 106 and the rear panel 108 (FIG. 7). Also as mentioned above, the pin receptacle 134 be configured to receive the pin 132 of the front panel 106 and the rear panel 108 (FIG. 7), thereby guiding the side panel 104 into a suitable position.

Specifically, at a first end 144 of the flange 140*b*, a cross-section of the flange 140*b* may remain substantially constant towards a second end 146 of the flange 140*b* until the hook 130. The hook 130 may be stamped or cut from the flange 140*b*. For example, the hook 130 may be formed within the flange 140*b*. That is, the flange 140*b* may have a shorter width extending from the vertical portion 116 relative to other portions of the flange 140*b*. Indeed, the flange 140*b* and the hook 130 may each be entirely disposed within a plane that has approximately the thickness of the flange 140*b*. The hook 130 may include a traditional hook shape, such as having an inset portion and having a portion that comes to a point, or a tip. From the hook 130, going towards the second end 146, the flange 140*b* may be substantially constant in cross section until the pin receptacle 134. Similar to the hook 130, the pin receptacle 134 and the flange 140*b* may be disposed within a plane that has approximately the thickness of the flange 140*b*. In other words, the flange 140*b*, may be substantially constant in thickness throughout its length. The pin receptacle 134 may include a portion that is inset towards the vertical portion 116 configured to receive the pin 132 (FIG. 7). In some embodiments, the pin receptacle 134 may include edges tapered toward the vertical portion 116, such as generally trapezoidal in shape, thereby increasing a tolerance of receiving and aligning the pin 132. The side panel 104 further includes a top flange 148 that extends from the vertical portion 116 adjacent to the first end 144. That is, the top flange 148 may be substantially parallel to the horizontal portion 118 and substantially perpendicular to the flange 140*b* and the vertical portion 116. The top flange 148 of the side panel 104 may be configured to cover top edges of the air conditioning unit 22, and more specifically, the housing 80, when the side panel 104 is rotated inward.

Figure 11:
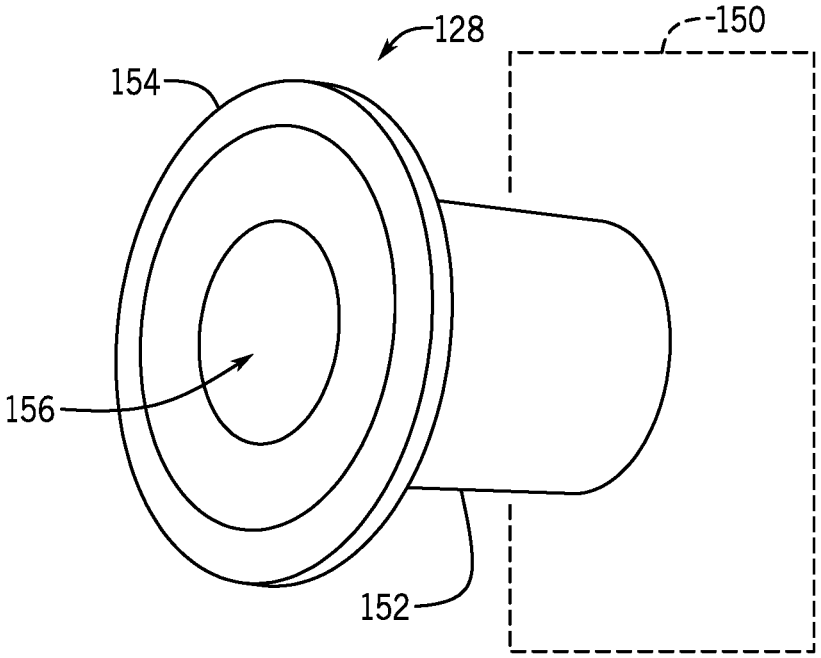
FIG. 11 is a perspective view of a mounting component that may be utilized within the air conditioning unit of FIG. 5, in accordance with an aspect of the present disclosure.

FIG. 11 is a perspective view of an embodiment of the shaft 128 coupled to a surface 150. Indeed, as discussed above, the surface 150 may be the front panel 106 and/or the rear panel 108. Also as mentioned above, the shaft 128 may include a shaft portion 152, which may be tapered, and a lip portion 154. The shaft portion 152 may be tapered with decreasing diameter from the lip 154 towards the surface 150. That is, the hooks 130 of the side panel 104 (FIG. 10) may be initially be positioned anywhere on the shaft be biased towards the surface 150 due to the tapered diameter of the shaft portion 152. Further, the lip portion 154 may block the hook 130 of the side panel 104 (FIG. 10) from sliding too far away from the surface 150. In this manner, the shape of the shaft 128 may provide for a simplified coupling of the side panels 104 onto the housing 80, and more specifically, onto the shaft 128. Further, due at least to the taper of the shaft portion 152, the hooks 130 of the side panels 104 may be biased towards the same position on the shaft 128 as the side panels 104 are rotated and each time the side panels 104 are placed on the shaft 128. In some embodiments, the shaft 128 may be coupled to the surface 150 via a fastener through a bore 156 disposed within the shaft portion 152.

Accordingly, the present disclosure is directed to an air conditioning unit mounted to a ceiling of a room within a building. Specifically, the air conditioning unit may be covered by a housing with one or more panels. The one or more panels may be configured to open such that internal components may be accessed through a horizontal plane of the housing and/or vertical (side) planes of the housing. For example, side panels of the chassis may be configured to expose the vertical planes of the housing despite minimal clearances between the housing and elements of the room, such as walls or ceilings. Therefore, the service personnel and/or operators may access the internal components of the air conditioning unit for installation or maintenance purposes in an efficient manner, thereby saving in time and costs associated with installation or maintenance.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out an embodiment, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A housing for a heating, ventilation, and/or air conditioning (HVAC) unit, comprising:

a top panel;

a front panel extending transverse to the top panel;

a rear panel extending transverse to the top panel;

a bottom panel configured to be disposed opposite to the top panel and to extend between the front panel and the rear panel;

an access panel including an L-shape having a first portion configured to extend transverse to the top panel and to extend between the front panel and the rear panel in an installed state, and the L-shape having a second portion extending transverse to the first portion and configured to be in alignment with the bottom panel in the installed state;

a flange extending along an edge of the first portion, wherein the flange includes a proximal end coupled to the edge and a distal end; and a hook-shaped notch formed in the flange and defining a portion of the distal end of the flange, wherein the hook-shaped notch is configured to hook around a shaft of the housing to enable engaged rotation of the access panel about the shaft and out of the installed state such that the second portion is angled relative to the bottom panel to enable access to an internal portion of the housing.

2. The housing of claim 1, comprising the shaft.

3. The housing of claim 2, wherein the shaft is configured to extend between the front panel and the rear panel.

4. The housing of claim 3, wherein the shaft is configured to be coupled to the front panel.

5. The housing of claim 4, wherein the shaft is configured to be coupled to the rear panel.

6. The housing of claim 2, wherein the shaft includes a shaft portion configured to be engaged by the hook-shaped notch, and a lip portion extending radially outwardly from the shaft portion and configured to retain an axial position of the hook-shaped notch about the shaft portion.

7. The housing of claim 1, wherein the flange and the second portion of the L-shape of the access panel extend in a common direction.

8. The housing of claim 1, wherein the top panel, the front panel, and the rear panel are components of a single piece of sheet metal.

9. The housing of claim 1, wherein the flange includes a pin receptacle disposed between the hook-shaped notch and a junction between the first portion and the second portion, and the pin receptacle is configured to receive a pin.

10. A housing for a heating, ventilation, and/or air conditioning (HVAC) unit, comprising:

a top panel;

a bottom panel disposed opposite to the top panel; and an access panel having a first portion extending in alignment with the bottom panel in an installed state, and a second portion extending transverse to the first portion and between the top panel and the bottom panel in the installed state;

a flange extending along an edge of the first portion in a common direction with the second portion, wherein the flange includes a proximal end contacting the edge and a distal end; and an open-ended hook formed in the flange and defining a portion of the distal end of the flange, wherein the open-ended hook is configured to hook around a shaft of the housing such that the shaft is not encircled by the open-ended hook and to enable engaged rotation of the access panel about the shaft and out of the installed state such that the second portion is angled relative to the bottom panel to enable internal access to the housing.

11. The housing of claim 10, comprising the shaft.

12. The housing of claim 11, comprising:

a front panel extending transverse to the top panel; and a rear panel extending transverse to the top panel and opposite the front panel, wherein the shaft extends between the front panel and the rear panel.

13. The housing of claim 12, wherein the shaft is coupled to the front panel.

14. The housing of claim 13, wherein the shaft is coupled to the rear panel.

15. The housing of claim 11, wherein the shaft includes a shaft portion engaged by the open-ended hook, and a lip portion extending outwardly from the shaft portion and configured to retain an axial position of the open-ended hook about the shaft portion.

16. The housing of claim 10, comprising:

a front panel extending transverse to the top panel; and a rear panel extending transverse to the top panel and opposite the front panel, wherein the housing includes a single piece of sheet metal having the top panel, the front panel, and the rear panel.

17. The housing of claim 10, wherein the flange includes a pin receptacle disposed between the open-ended hook and a junction between the first portion and the second portion, and the pin receptacle is configured to receive a pin.

18. A housing for a heating, ventilating, and air conditioning (HVAC) unit, comprising:

a single piece of sheet metal including a top panel, a front panel extending transverse to the top panel, and a rear panel extending transverse to the top panel;

a bottom panel disposed opposite to the top panel and between the front panel and the rear panel; and an access panel including an L-shape having a first part disposed within an access plane of the HVAC unit in an installed state and a second part extending transverse to the first part and extending in alignment with the bottom panel in the installed state, wherein the first part portion includes an edge and a flange having a proximal end extending along the edge and a distal end opposing the proximal end, wherein the distal end comprises a first portion extending parallel to the edge, a second portion extending parallel to the edge, and a hook formed in the flange and defining a third portion of the distal end between the first portion and the second portion of the distal end, and wherein the hook is configured to hook around a shaft of the housing to facilitate engaged rotation of the access panel about the shaft and out of the installed state such that the first part is removed from the access plane and the second part is angled relative to the bottom panel to enable internal access to the housing.

19. The housing of claim 18, comprising the shaft.

20. The housing of claim 19, wherein the shaft extends between the front panel and the rear panel.

21. The housing of claim 20, wherein the shaft is coupled to the front panel.

22. The housing of claim 21, wherein the shaft is coupled to the rear panel.

23. The housing of claim 19, wherein the shaft includes a shaft portion engaged by the hook, and a lip portion extending outwardly from the shaft portion and configured to retain an axial position of the hook about the shaft portion.

24. The housing of claim 18, wherein the flange includes a pin receptacle disposed between the hook and a junction between the first portion and the second portion, and the pin receptacle is configured to receive a pin.

* * * * *